US012716408B2

(12) United States Patent
Hu

(10) Patent No.: US 12,716,408 B2
(45) Date of Patent: Aug. 25, 2026

(54) CYLINDER ASSEMBLY AND COMPRESSOR HAVING THE SAME

(71) Applicant: ANHUI MEIZHI COMPRESSOR CO., LTD., Hefei (CN)

(72) Inventor: Binbin Hu, Hefei (CN)

(73) Assignee: ANHUI MEIZHI COMPRESSOR CO., LTD., Hefei (CN)

( * ) Notice: Subject to any disclaimer, the term of this patent is extended or adjusted under 35 U.S.C. 154(b) by 43 days.

(21) Appl. No.: 17/730,725

(22) Filed: Apr. 27, 2022

(65) Prior Publication Data

US 2022/0260066 A1 Aug. 18, 2022

Related U.S. Application Data

(63) Continuation of application No. PCT/CN2021/082984, filed on Mar. 25, 2021.

(30) Foreign Application Priority Data

May 29, 2020 (CN) ..... 202010477112.1

(51) Int. Cl.
*F04B 39/12* (2006.01)
*F04B 39/00* (2006.01)
*F04B 39/10* (2006.01)

(52) U.S. Cl.
CPC ..... *F04B 39/12* (2013.01); *F04B 39/0027* (2013.01); *F04B 39/10* (2013.01); *F04B 39/122* (2013.01); *F04B 39/125* (2013.01)

(58) Field of Classification Search
CPC ..... F04B 39/12; F04B 39/0027; F04B 39/10; F04B 39/123; F04B 39/125; F04B 39/122;

(Continued)

(56) References Cited

U.S. PATENT DOCUMENTS

2009/0068029 A1* 3/2009 Brabek ..... F04B 39/122 417/312
2016/0131123 A1* 5/2016 Kim ..... F04B 39/123 417/312

(Continued)

FOREIGN PATENT DOCUMENTS

CN 101194106 A 6/2008
CN 203822587 U 9/2014

(Continued)

OTHER PUBLICATIONS

International Search Report dated May 28, 2021 received in International application No. PCT/CN2021/082984 together with an English language translation.

(Continued)

*Primary Examiner* — Dominick L Plakkoottam
(74) *Attorney, Agent, or Firm* — Scully, Scott, Murphy & Presser, P.C.

(57) ABSTRACT

A cylinder assembly and a compressor having the cylinder assembly are provided. The cylinder assembly has a cylinder body, a valve assembly, a cylinder cover, a muffler, and a pressing cap. The valve assembly is arranged in the cylinder body. A sealing ring is arranged between the cylinder cover and the valve assembly. The muffler and the cylinder cover are integrally formed. The pressing cap is connected to the cylinder body. The cylinder cover is located between the cylinder body and the pressing cap, such that the pressing cap fixes the cylinder cover on the cylinder body.

14 Claims, 7 Drawing Sheets

(58) Field of Classification Search
CPC ..... F04B 39/00; F04B 39/0083; F04B 39/14; F05B 2210/14
See application file for complete search history.

(56) References Cited

U.S. PATENT DOCUMENTS

| | | | | |
|---|---|---|---|---|
| 2016/0131124 | A1* | 5/2016 | Kim | F04B 39/0061 417/374 |
| 2020/0011315 | A1 | 1/2020 | Jang et al. | |

FOREIGN PATENT DOCUMENTS

| | | | | |
|---|---|---|---|---|
| CN | 205036534 | U | | 2/2016 |
| CN | 205089566 | U | | 3/2016 |
| CN | 206206126 | U | * | 5/2017 |
| CN | 206221212 | U | | 6/2017 |
| CN | 106996364 | A | | 8/2017 |
| CN | 207393430 | U | | 5/2018 |
| CN | 108278191 | A | | 7/2018 |
| CN | 109488570 | A | | 3/2019 |
| CN | 109654022 | A | | 4/2019 |
| KR | 10-0143182 | B1 | | 8/1998 |

OTHER PUBLICATIONS

First Office Action dated Mar. 18, 2022 received in Chinese Patent Application No. CN 202010477112.1 together with an English language translation.
International Search Report dated May 28, 2021 received in international Application No. PCT/CN2021/082984.
First Office Action dated Mar. 18, 2022 received in Chinese Patent Application No. CN 202010477112.1.
Second Office Action dated Jun. 15, 2022 received in Chinese Patent Application No. CN 202010477112.1 together with an English language translation.
Request for the Submission of an Opinion dated Dec. 20, 2023 received in Korean Patent Application No. KR 10-2022-7016400.
Notice of Final Rejection dated Mar. 19, 2024 received in Korean Patent Application No. KR 10-2022-7016400.

* cited by examiner

CYLINDER ASSEMBLY AND COMPRESSOR HAVING THE SAME

CROSS-REFERENCES TO RELATED APPLICATIONS

This application is a continuation application of PCT International Patent Application No. PCT/CN2021/082984, filed on Mar. 25, 2021, which claims priority to and benefits of Chinese Patent Application No. 202010477112.1, filed on May 29, 2020, the entire contents of which are incorporated herein by reference for all purposes. No new matter has been introduced.

FIELD

The present disclosure relates to the field of compressors, and in particular, to a cylinder assembly and a compressor having the cylinder assembly.

BACKGROUND

Reciprocating compressors are mostly used in refrigeration devices, such as refrigerators and freezers in the related art. The cylinder cover of the pneumatic cylinder of a reciprocating compressor is mounted on the cylinder body of the pneumatic cylinder by screws. The cylinder body will be deformed due to the large torque of the screws used for mounting the cylinder cover, causing jam of the piston and operation failure of the compressor.

SUMMARY

The present disclosure aims to solve at least one of the technical problems in the related art to a certain extent. To this end, certain embodiments of the present disclosure propose a cylinder assembly and a compressor having the cylinder assembly.

A cylinder assembly according to an embodiment of the present disclosure includes: a cylinder body; a valve assembly arranged in the cylinder body; a cylinder cover, wherein a sealing ring is arranged between the cylinder cover and the valve assembly; a muffler, the muffler and the cylinder cover being integrally formed by injection molding; and a pressing cap connected to the cylinder body, wherein the cylinder cover is located between the cylinder body and the pressing cap in such a manner that the pressing cap fixes the cylinder cover on the cylinder body.

The cylinder assembly according to the embodiment of the present disclosure has the advantages, such as a good sealing effect, a small number of parts, low manufacturing difficulty and cost, and no deformation of the cylinder cover and the cylinder body.

Optionally, the cylinder assembly further includes an elastic member, and the elastic member is annular, arranged between the cylinder cover and the pressing cap, and in a compressed state.

Optionally, the cylinder body has a counterbore hole defined at one end thereof, the valve assembly is arranged in the counterbore hole, and the cylinder assembly further includes a valve plate gasket arranged between a bottom wall surface of the counterbore hole and the valve assembly.

Optionally, the counterbore hole has one of a first positioning protrusion and a positioning groove provided on a peripheral wall surface thereof, the valve plate gasket and the valve assembly have the other one of the first positioning protrusion and the positioning groove provided on peripheral surfaces thereof, and the first positioning protrusion fits in the positioning groove.

Optionally, the sealing ring includes an annular portion and a partition portion, the partition portion has a first end and a second end, each of the first end and the second end is connected to an inner edge of the annular portion to partition an inner space of the annular portion into two parts.

Optionally, the cylinder cover has an accommodating groove provided thereon, the sealing ring is partially disposed in the accommodating groove, the sealing ring has one of a second positioning protrusion and a positioning hole provided thereon, the cylinder cover has the other one of the second positioning protrusion and the positioning hole provided thereon, and the second positioning protrusion is disposed in the positioning hole.

Optionally, the sealing ring further includes a positioning portion provided on the inner edge of the annular portion, the positioning portion extends from the inner edge of the annular portion towards a center of the annular portion, and the one of the second positioning protrusion and the positioning hole is provided on the positioning portion.

Optionally, the elastic member is a disc spring.

Optionally, the cylinder body has a first mounting portion and a second mounting portion provided thereon, and the pressing cap includes a cap body, a third mounting portion and a fourth mounting portion, and the third mounting portion and the fourth mounting portion are connected to the cap body, wherein the cap body abuts on the elastic member, the third mounting portion is connected to the first mounting portion through a fastener, and the fourth mounting portion is connected to the second mounting portion through a fastener.

Optionally, each of the third mounting portion and the fourth mounting portion is L-shaped, a vertical portion of each of the third mounting portion and the fourth mounting portion is connected to the cap body, a horizontal portion of the third mounting portion is connected to the first mounting portion through a fastener, and a horizontal portion of the fourth mounting portion is connected to the second mounting portion through a fastener.

Optionally, one end of the cylinder body close to the valve assembly has a first protrusion and a second protrusion provided on an outer peripheral surface thereof, the pressing cap includes a cap body, a third mounting portion and a fourth mounting portion, the third mounting portion and the fourth mounting portion are connected to the cap body, the cap body abuts on the elastic member, the third mounting portion has a first buckle provided thereon, the fourth mounting portion has a second buckle provided thereon, the first buckle is snapped on the first protrusion, the second buckle is snapped on the second protrusion, and optionally, the first protrusion and the second protrusion are integrally formed as an annular flange.

A compressor according to an embodiment of the present disclosure includes the cylinder assembly according to the embodiment of the present disclosure.

The compressor according to the embodiment of the present disclosure has the advantages of no cylinder jam phenomenon and no deformation of the cylinder body.

BRIEF DESCRIPTION OF DRAWINGS

In order to more clearly illustrate embodiments of the present disclosure or technical solutions in the related art, drawings used in the description of the embodiments or the related art are briefly described below. Apparently, the drawings as described below are merely some embodiments of the present disclosure. Based on these drawings, other drawings can be obtained by those skilled in the art according to the structures shown in these drawings without creative effort.

Figure 1:
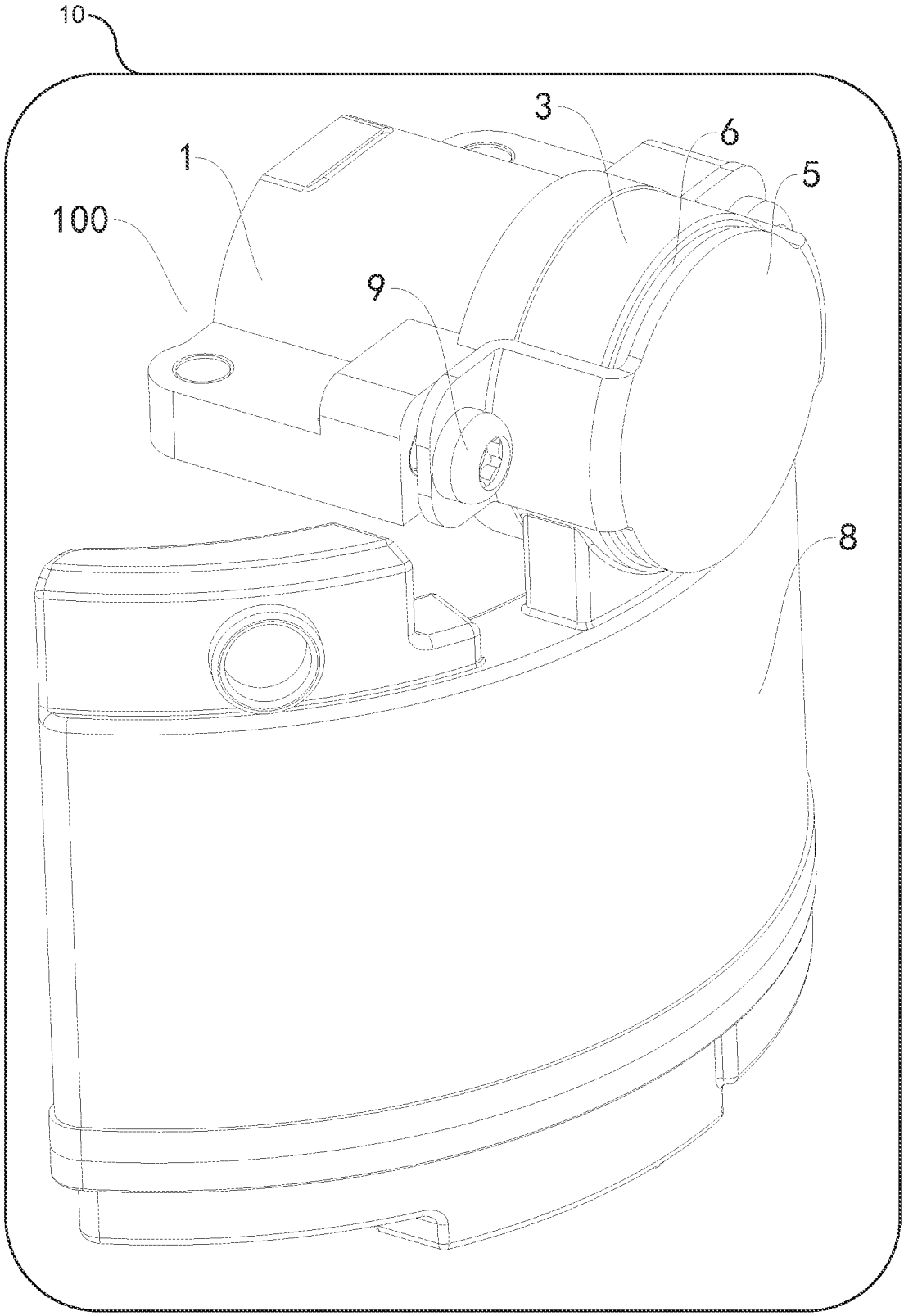
FIG. 1 is a structural schematic diagram of a cylinder assembly according to an embodiment of the present disclosure.

The implementation, functions and characteristics, and advantages of the purpose of the present disclosure will be further described in conjunction with the embodiments with reference to the accompanying drawings.

DESCRIPTION OF EMBODIMENTS

Technical solutions according to embodiments of the present disclosure will be clearly and completely described below in combination with accompanying drawings of the embodiments of the present disclosure. Apparently, the embodiments described below are only a part of the embodiments of the present disclosure, rather than all of the embodiments. Based on the embodiments in the present disclosure, all other embodiments obtained by those skilled in the art without creative labor shall fall within the protection scope of the present disclosure.

It should be noted that all directional indications (such as up, down, left, right, front, rear, etc.) in the embodiments of the present disclosure are merely used to explain the relative positional relationship, the movement situation, etc. between various components under a certain specific pose (as shown in the accompanying drawing). If the pose changes, the directional indication also changes accordingly.

In addition, descriptions involving "first", "second", etc. in the present disclosure are used herein for purposes of description and are not intended to indicate or imply relative importance, or to implicitly show a number of technical features indicated. Thus, a feature defined with "first" and "second" may explicitly or implicitly include one or more of the features. In addition, the technical solutions of the various embodiments can be combined with each other, as long as the combination is implementable by those of ordinary skill in the art. When the combination of technical solutions has mutual contradiction or cannot be implemented, it should be considered that the combination of such technical solutions does not exist, and is not within the protection scope claimed in the present disclosure.

The cylinder assembly 100 according to the embodiments of the present disclosure will be described below with reference to the accompanying drawings. As shown in FIGS. 1 to 10, a cylinder assembly 100 according to an embodiment of the present disclosure includes a cylinder body 1, a valve assembly 2, a cylinder cover 3, a pressing cap 5 and a muffler 8.

The valve assembly 2 is arranged in the cylinder body 1, and a sealing ring 4 is arranged between the cylinder cover 3 and the valve assembly 2. The muffler 8 and the cylinder cover 3 are integrally formed by injection molding. The pressing cap 5 is connected to the cylinder body 1, and the cylinder cover 3 is located between the cylinder body 1 and the pressing cap 5 in such a manner that the pressing cap 5 fixes the cylinder cover 3 on the cylinder body 1, that is, the cylinder cover 3 is sandwiched between the cylinder body 1 and the pressing cap 5.

In the cylinder assembly 100 according to certain embodiment of the present disclosure, the muffler 8 and the cylinder cover 3 are integrally formed by injection molding, such that the number of parts of the cylinder assembly 100 can be reduced, and the manufacturing difficulty and manufacturing cost of the cylinder assembly 100 can be lowered.

However, if the cylinder cover 3 made of plastic is mounted on the cylinder body 1 by means of fasteners (such as, screws or bolts), the cylinder cover 3 will be deformed or even damaged. The cylinder assembly 100 according to certain embodiment of the present disclosure can greatly reduce the force on the cylinder cover 3 by using the pressing cap 5 to fix the cylinder cover 3 on the cylinder body 1, so as to avoid deformation or even damage of the cylinder cover 3.

Moreover, in the cylinder assembly 100 according to certain embodiment of the present disclosure, the sealing ring 4 with good sealing performance is arranged between the cylinder cover 3 and the valve assembly 2, such that the pressing cap 5 only needs to exert a small pressure to implement the sealing of the valve assembly 2. Therefore, the force applied by the pressing cap 5 on the cylinder body 1 can be greatly reduced, such that the deformation of the cylinder body 1 can be avoided, and the normal operation of the cylinder assembly 100 and a compressor 10 including cylinder assembly 100 can be ensured.

Therefore, the cylinder assembly 100 according to certain embodiment of the present disclosure has the advantages, such as a good sealing effect, a small number of parts, low manufacturing difficulty and cost, and no deformation of the cylinder cover 3 and the cylinder body 1.

As shown in FIGS. 1 to 10, the cylinder assembly 100 includes the cylinder body 1, the valve assembly 2, the cylinder cover 3, the pressing cap 5 and an elastic member 6. The cylinder body 1 has a counterbore hole 11 defined at one end thereof, and the valve assembly 2 is arranged in the counterbore hole 11.

The elastic member 6 is annular, arranged between the cylinder cover 3 and the pressing cap 5, and in a compressed state. In other words, the elastic member 6 is sandwiched between the cylinder cover 3 and the pressing cap 5. Optionally, the elastic member 6 is a disc spring.

By arranging the annular elastic member 6 between the cylinder cover 3 and the pressing cap 5, the pressure exerted by the pressing cap 5 can be uniformly transmitted to the cylinder cover 3 through the elastic member 6, such that the cylinder cover 3 can press the sealing ring 4 tight on the valve assembly 2 to further improve the sealing effect.

Figure 2:
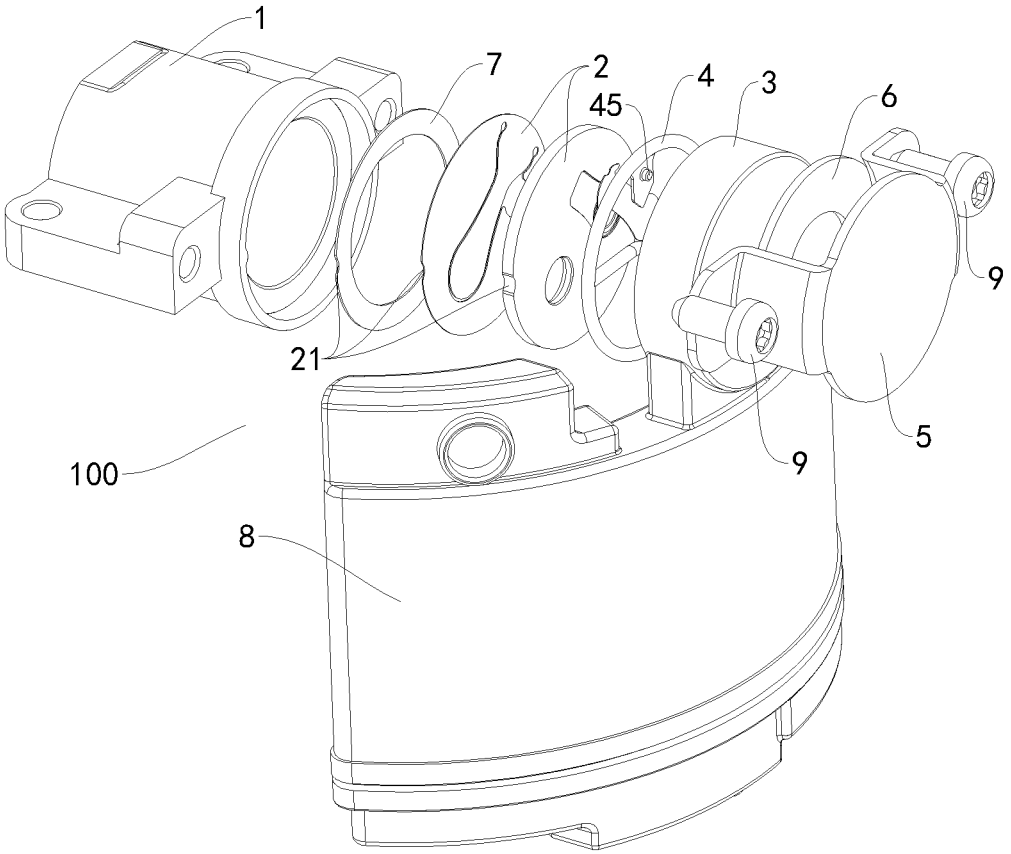
FIG. 2 is an exploded view of a cylinder assembly according to an embodiment of the present disclosure.
Figure 3:
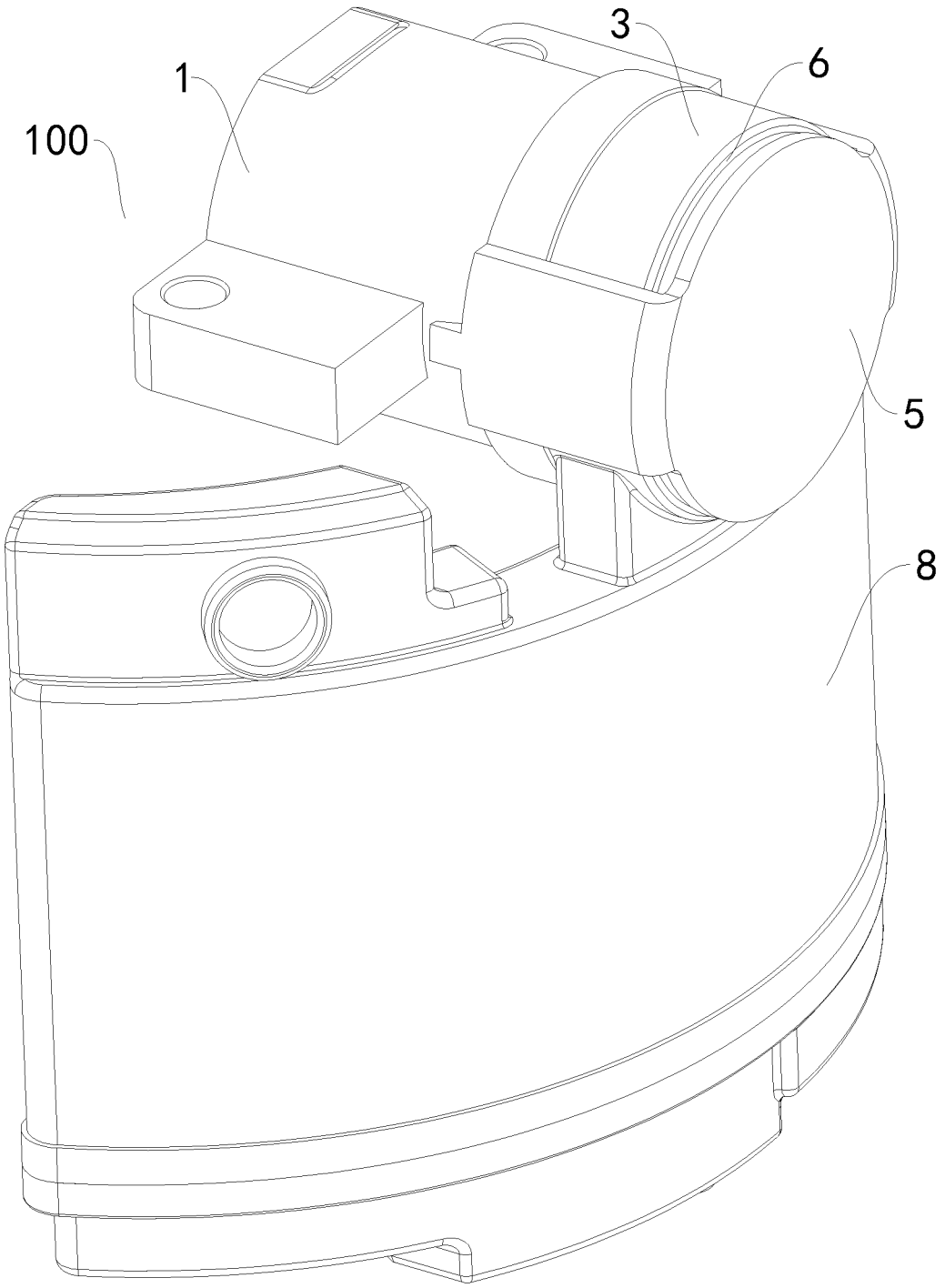
FIG. 3 is a structural schematic diagram of a cylinder assembly according to an embodiment of the present disclosure.
Figure 4:
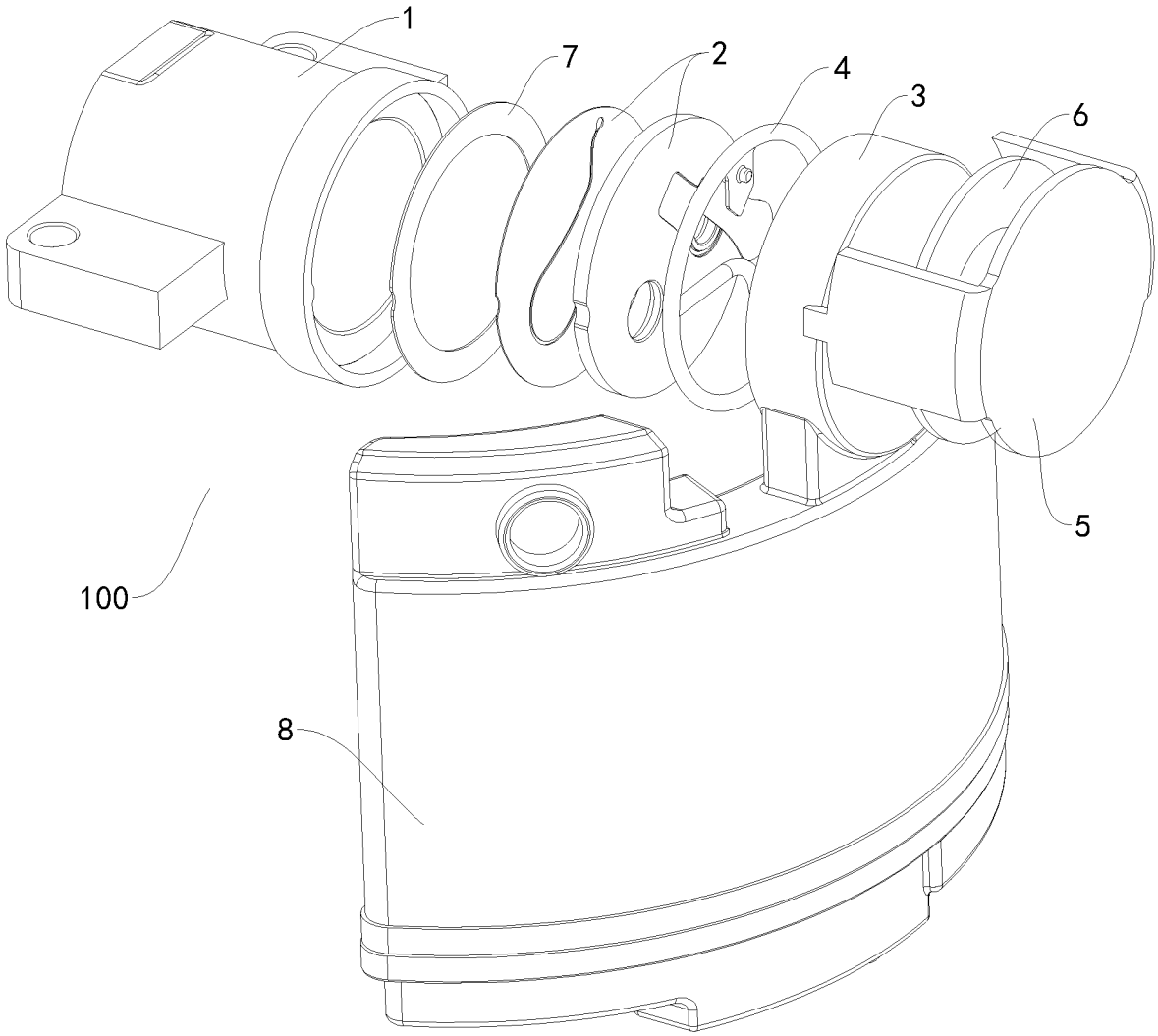
FIG. 4 is an exploded view of a cylinder assembly according to an embodiment of the present disclosure.

As shown in FIGS. 2 and 4, the cylinder assembly 100 may further include a valve plate gasket 7 arranged between a bottom wall surface 113 of the counterbore hole 11 and the valve assembly 2. The bottom wall surface 113 of the counterbore hole 11 is a wall surface of the counterbore hole 11 opposite to an opening of the counterbore hole 11. As a result, the air-tightness of the valve assembly 2 can be further improved.

Figure 5:
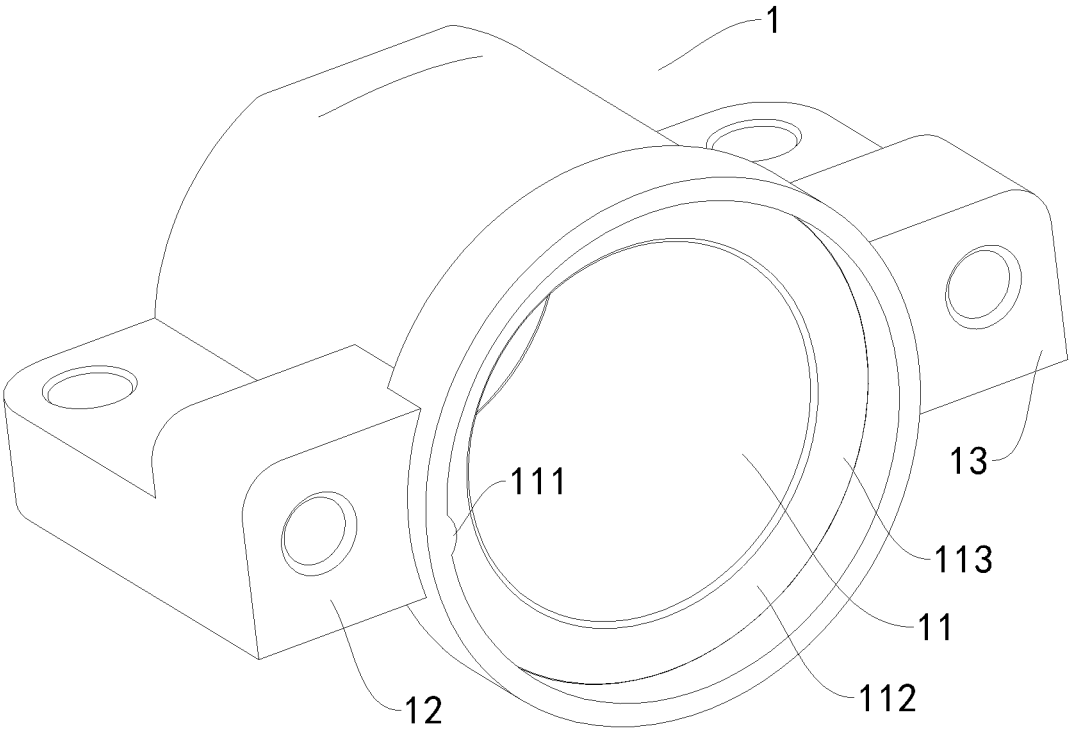
FIG. 5 is a structural schematic diagram of a cylinder body of a cylinder assembly according to an embodiment of the present disclosure.

As shown in FIG. 2, FIG. 4 and FIG. 5, the counterbore hole 11 has one of a first positioning protrusion 111 and a positioning groove 21 provided on a peripheral wall surface 112 thereof, the valve plate gasket 7 and the valve assembly 2 have the other one of the first positioning protrusion 111 and the positioning groove 21 provided on peripheral surfaces thereof, and the first positioning protrusion 111 fits in the positioning groove 21. Therefore, the difficulty of positioning the valve plate gasket 7 and the valve assembly 2 can be lowered, and the positioning accuracy of the valve plate gasket 7 and the valve assembly 2 can be improved.

Optionally, the counterbore hole 11 has a first positioning protrusion 111 provided on a peripheral wall surface 112 thereof to avoid lowering the structural strength of the cylinder body 1. The valve plate gasket 7 has a positioning groove 21 provided on a peripheral surface thereof, and the valve assembly 2 has a positioning groove 21 provided on a peripheral surface thereof.

Figure 9:
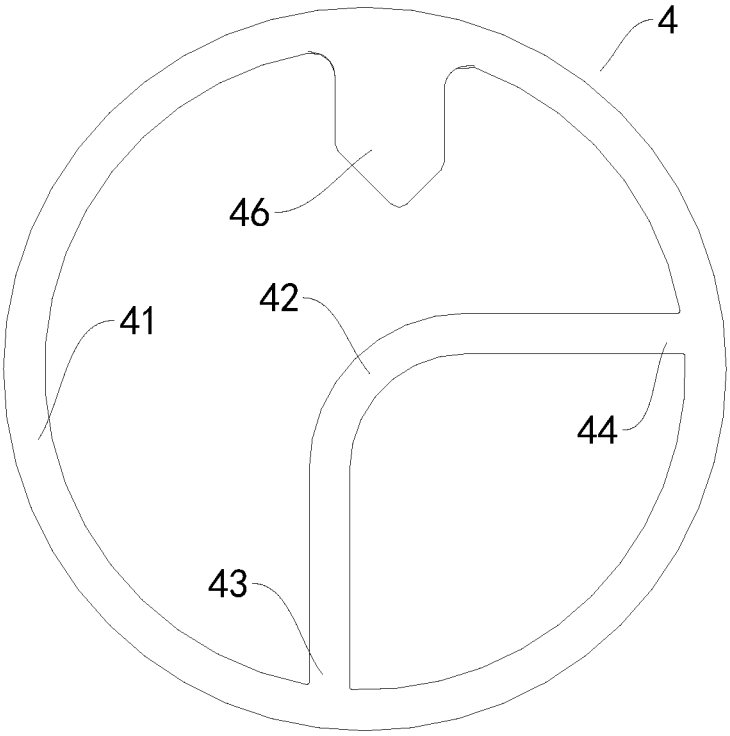
FIG. 9 is a structural schematic diagram of a sealing ring of a cylinder assembly according to an embodiment of the present disclosure.

As shown in FIG. 9, the sealing ring 4 includes an annular portion 41 and a partition portion 42, the partition portion 42 has a first end 43 and a second end 44, each of the first end 43 and the second end 44 is connected to an inner edge of the annular portion 41 to partition an inner space of the annular portion 41 into two parts. As a result, an air suction side and an air exhaust side of the valve assembly 2 can be effectively separated, such that the cylinder assembly 100 has better sealing performance. Optionally, the partition portion 42 is L-shaped.

Figure 10:
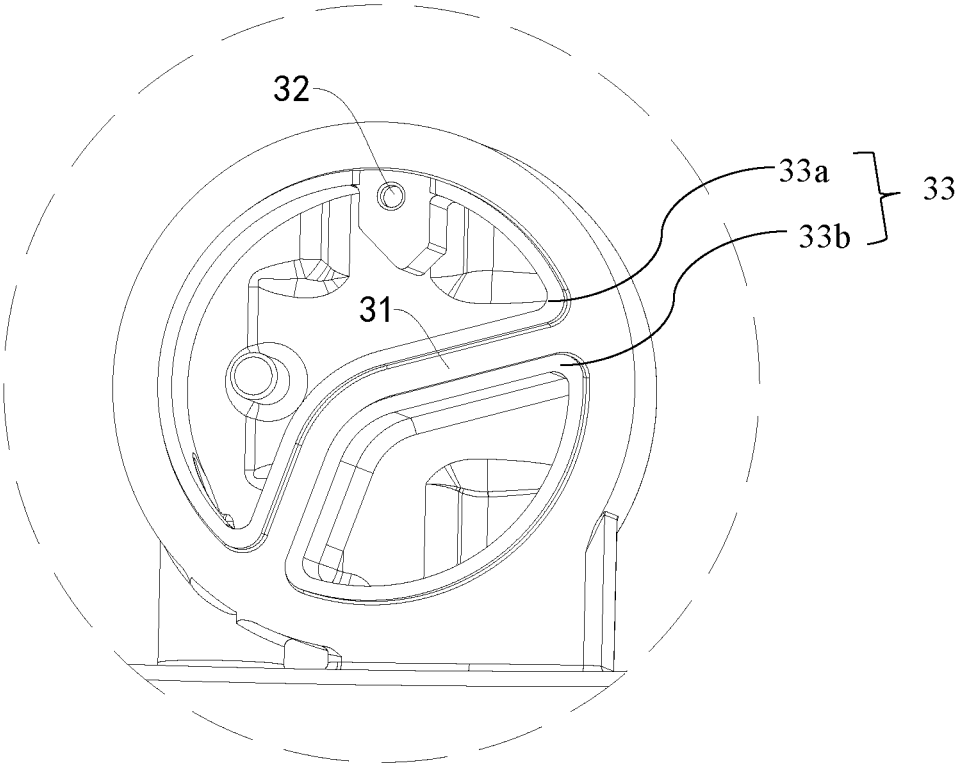
FIG. 10 is a partial structural schematic diagram of a cylinder cover of a cylinder assembly according to an embodiment of the present disclosure.

As shown in FIG. 10, the cylinder cover 3 has an accommodating groove 31 formed by opposing protrusions 33*a*, 33*b* in a central portion 33 of the cylinder cover 3 provided thereon, the sealing ring 4 is partially disposed in the accommodating groove 31. Thus, the sealing ring 4 can be mounted more stably, and the sealing ring 4 can be prevented from being greatly deformed in a radial direction of the sealing ring 4 under the squeezing by the cylinder cover 3 and the valve assembly 2, that is, at least a part of the sealing ring 4 is prevented from generating a large displacement in the radial direction of the sealing ring 4 under the squeezing by the cylinder cover 3 and the valve assembly 2, thereby further improving the sealing effect.

As shown in FIGS. 9 and 10, the sealing ring 4 has one of a second positioning protrusion 45 and a positioning hole 32 provided thereon, the cylinder cover 3 has the other one of the second positioning protrusion 45 and the positioning hole 32 provided thereon, and the second positioning protrusion 45 is disposed in the positioning hole 32. Thus, the sealing ring 4 can be mounted more stably, and the sealing ring 4 can be further prevented from being greatly deformed in the radial direction of the sealing ring 4 under the squeezing by the cylinder cover 3 and the valve assembly 2, such that the sealing effect can be further improved.

As shown in FIG. 9, the sealing ring 4 further includes a positioning portion 46. The positioning portion 46 is provided on the inner edge of the annular portion 41, and the positioning portion 46 extends from the inner edge of the annular portion 41 towards a center of the annular portion 41. Optionally, the positioning portion 46 may extend in a radial direction of the annular portion 41 (the sealing ring 4). The one of the second positioning protrusion 45 and the positioning hole 32 is provided on the positioning portion 46. Thus, the structure of the sealing ring 4 can be made more reasonable.

Optionally, the second positioning protrusion 45 is provided on the positioning portion 46, and the cylinder cover 3 has the positioning hole 32 defined thereon. The sealing ring 4 can be integrally formed by injection molding with rubber.

As shown in FIGS. 1, 2, 5 and 6, the cylinder body 1 has a first mounting portion 12 and a second mounting portion 13 provided thereon, optionally, the cylinder body 1, the first mounting portion 12, and the second mounting portion 13 may be integrally formed. For example, the cylinder body 1, the first mounting portion 12, and the second mounting portion 13 may be integrally formed by sintering.

The pressing cap 5 includes a cap body 51, a third mounting portion 52, and a fourth mounting portion 53, and the third mounting portion 52 and the fourth mounting portion 53 are connected to the cap body 51. The cap body 51 abuts against the elastic member 6, that is, the elastic member 6 is sandwiched between the cylinder cover 3 and the cap body 51. The third mounting portion 52 is connected to the first mounting portion 12 through a fastener 9, and the fourth mounting portion 53 is connected to the second mounting portion 13 through a fastener 9, such that the cap body 51 can abut (press) against the elastic member 6.

Since the sealing ring 4 has a good sealing effect, the fastener 9 only needs a small torque to achieve the sealing of the valve assembly 2. Therefore, the deformation of the cylinder body 1 can be avoided, and the normal operation of the cylinder assembly 100 and the compressor 10 can be ensured.

Figure 6:
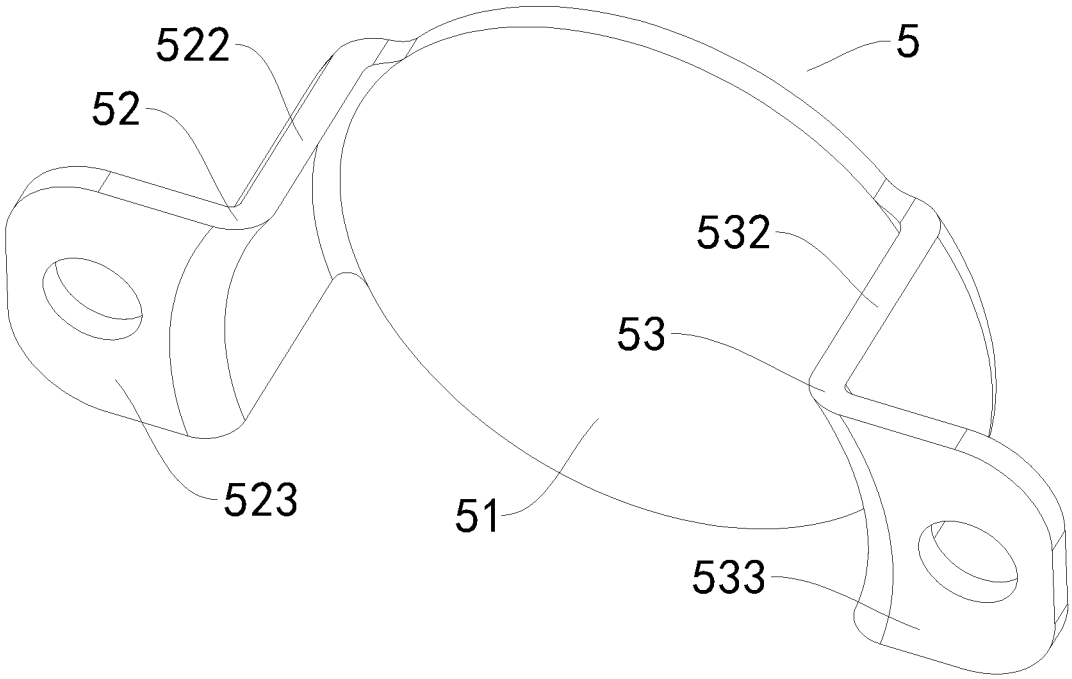
FIG. 6 is a structural schematic diagram of a pressing cap of a cylinder assembly according to an embodiment of the present disclosure.
Figure 7:
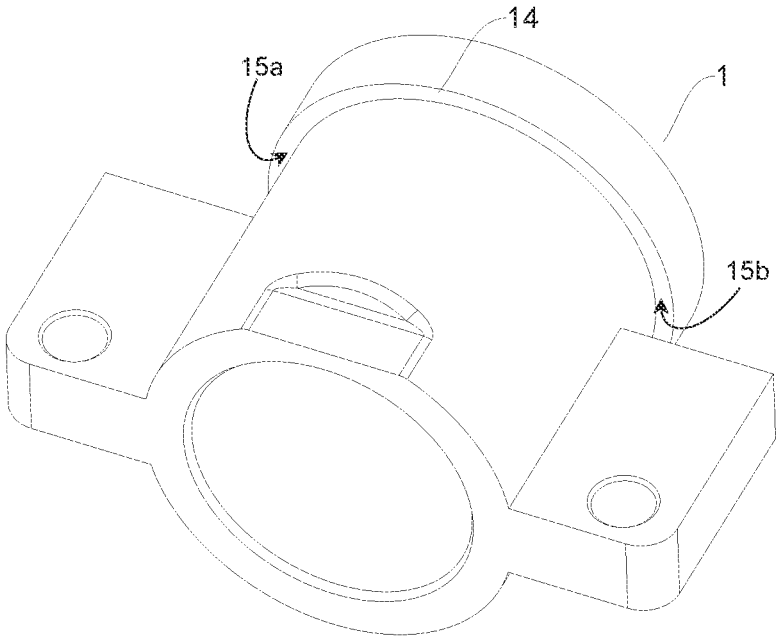
FIG. 7 is a structural schematic diagram of a cylinder body of a cylinder assembly according to an embodiment of the present disclosure.
Figure 8:
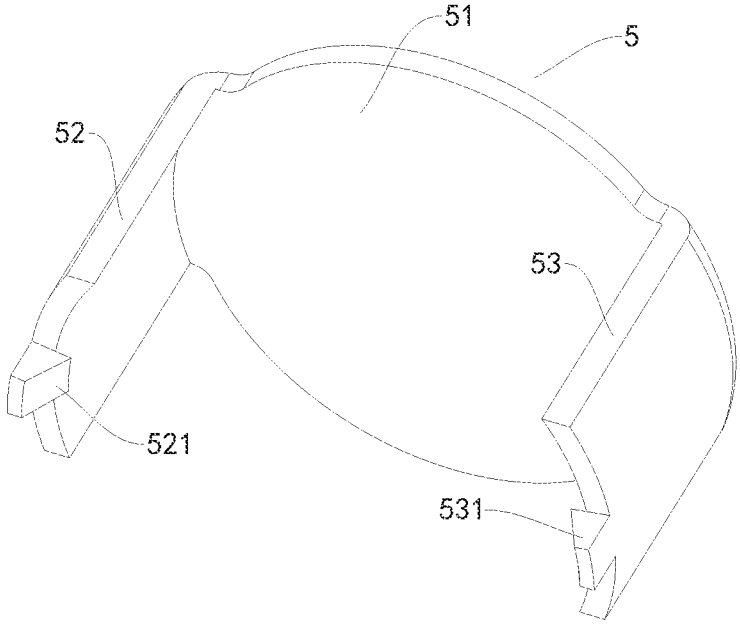
FIG. 8 is a structural schematic diagram of a pressing cap of a cylinder assembly according to an embodiment of the present disclosure.

Optionally, as shown in FIGS. 1, 2 and 6, each of the third mounting portion 52 and the fourth mounting portion 53 is L-shaped, and a vertical portion 522 of the third mounting portion 52 and a vertical portion 532 of the fourth mounting portion 53 are connected to the cap body 51, a horizontal portion 523 of the third mounting portion 52 is connected to the first mounting portion 12 through a fastener 9, and a horizontal portion 533 of the fourth mounting portion 53 is connected to the second mounting portion 13 through a fastener 9.

For example, the cap body 51, the third mounting portion 52, and the fourth mounting portion 53 may be integrally formed, and the fastener 9 may be a screw or a bolt.

As shown in FIGS. 3, 4, 7 and 8, one end of the cylinder body 1 close to the valve assembly 2 has a first protrusion 15*a* and a second protrusion 15*b* provided on an outer peripheral surface thereof, the pressing cap 5 includes a cap body 51, a third mounting portion 52, and a fourth mounting portion 53, and the third mounting portion 52 and the fourth mounting portion 53 are connected to the cap body 51. The cap body 51 abuts against the elastic member 6, and the third mounting portion 52 has a first buckle 521 provided thereon, the fourth mounting portion 53 has a second buckle 531 provided thereon, the first buckle 521 is snapped on the first protrusion 15*a*, the second buckle 531 is snapped on the second protrusion 15*b*. As a result, the pressing cap 5 can be more conveniently and easily mounted on the cylinder body 1.

Optionally, the first protrusion 15*a* and the second protrusion 15*b* are integrally formed as an annular flange 14, that is, the outer peripheral surface of the cylinder body 1 has an annular flange 14 provided thereon. Therefore, it is not necessary to mount the pressing cap 5 on the cylinder body 1 at a specific position, such that the pressing cap 5 can be more conveniently and easily mounted on the cylinder body 1. The flange 14 and the cylinder body 1 may be integrally formed, and the cap body 51, the third mounting portion 52, and the fourth mounting portion 53 may be integrally formed.

The present disclosure also provides a compressor. The compressor according to an embodiment of the present disclosure includes the cylinder assembly 100 according to the above embodiment of the present disclosure. Therefore, the compressor according to certain embodiment of the present disclosure has the advantages of no cylinder jam phenomenon, no deformation of the cylinder body 1, stable operation, etc.

The above are only the preferred embodiments of the present disclosure, and are not intended to limit the patent scope of the present disclosure. Any equivalent structural transformations made within the ideas of the present disclosure based on the contents of the description and drawings of the present disclosure, or direct/indirect applications in other related technical fields are included in the claimed protection scope of the present disclosure.

What is claimed is:

1. A cylinder assembly comprising:
a cylinder body;
a valve assembly arranged in the cylinder body;
a cylinder cover comprising an accommodating groove formed by opposing protrusions in a central portion of the cylinder cover;
a sealing ring arranged between the cylinder cover and the valve assembly, and partially disposed in the accommodating groove;
a muffler; and
a pressing cap connected to the cylinder body,
wherein the cylinder cover is located between the cylinder body and the pressing cap, such that the pressing cap fixes the cylinder cover on the cylinder body.

2. The cylinder assembly according to claim 1, wherein the muffler and the cylinder cover are integrally formed by injection molding.

3. The cylinder assembly according to claim 1, further comprising an elastic member, wherein the elastic member is annular and arranged between the cylinder cover and the pressing cap, and wherein the elastic member in a compressed state.

4. The cylinder assembly according to claim 1, wherein:
the cylinder body has a counterbore hole defined at one end of the cylinder body,
the valve assembly is arranged in the counterbore hole, and
the cylinder assembly further comprises a valve plate gasket arranged between a bottom wall surface of the counterbore hole and the valve assembly.

5. The cylinder assembly according to claim 4, wherein:
the counterbore hole has one of a first positioning protrusion and a positioning groove provided on a peripheral wall surface of the counterbore hole,
the valve plate gasket and the valve assembly have the other one of the first positioning protrusion and the positioning groove provided on peripheral surfaces of the valve plate gasket and the valve assembly, and
the first positioning protrusion fits in the positioning groove.

6. The cylinder assembly according to claim 1, wherein:
the sealing ring comprises an annular portion and a partition portion,
the partition portion has a first end and a second end, and
each of the first end and the second end is connected to an inner edge of the annular portion to partition an inner space of the annular portion into two parts.

7. The cylinder assembly according to claim 1, wherein:
the sealing ring has one of a second positioning protrusion and a positioning hole,
the cylinder cover has the other one of the second positioning protrusion and the positioning hole, and
the second positioning protrusion is disposed in the positioning hole.

8. The cylinder assembly according to claim 7, wherein:
the sealing ring further comprises a positioning portion provided on an inner edge of an annular portion of the sealing ring,
the positioning portion extends from the inner edge of the annular portion towards a center of the annular portion, and
the one of the second positioning protrusion and the positioning hole is provided on the positioning portion.

9. The cylinder assembly according to claim 3, wherein the elastic member comprises a disc spring.

10. The cylinder assembly according to claim 1, further comprising an elastic member arranged between the cylinder cover and the pressing cap,
wherein:
the cylinder body has a first mounting portion and a second mounting portion,
the pressing cap comprises a cap body, a third mounting portion and a fourth mounting portion, and
the third mounting portion and the fourth mounting portion are connected to the cap body,
wherein the cap body abuts the elastic member, the third mounting portion is connected to the first mounting portion, and the fourth mounting portion is connected to the second mounting portion.

11. The cylinder assembly according to claim 10, wherein:
each of the third mounting portion and the fourth mounting portion is L-shaped,
a vertical portion of each of the third mounting portion and the fourth mounting portion is connected to the cap body,
a horizontal portion of the third mounting portion is connected to the first mounting portion, and
a horizontal portion of the fourth mounting portion is connected to the second mounting portion.

12. The cylinder assembly according to claim 1, wherein:
one end of the cylinder body close to the valve assembly has a first protrusion and a second protrusion provided on an outer peripheral surface of the end,
the pressing cap comprises a cap body, a third mounting portion and a fourth mounting portion,
the third mounting portion and the fourth mounting portion are connected to the cap body,
the cap body abuts an elastic member arranged between the cylinder cover and the pressing cap,
the third mounting portion has a first buckle,
the fourth mounting portion has a second buckle, and
the first buckle is snapped on the first protrusion, and the second buckle is snapped on the second protrusion.

13. The cylinder assembly according to claim 12, wherein the first protrusion and the second protrusion are integrally formed as an annular flange.

14. A compressor comprising the cylinder assembly according to claim 1.

* * * * *